US008213822B2

(12) United States Patent
Cook et al.

(10) Patent No.: US 8,213,822 B2
(45) Date of Patent: Jul. 3, 2012

(54) POWER CONTROL FOR A PRINTER FUSER

(75) Inventors: William Paul Cook, Lexington, KY (US); Michael Charles Day, Lexington, KY (US); Wesley David McIntire, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 648 days.

(21) Appl. No.: 12/346,135

(22) Filed: Dec. 30, 2008

(65) Prior Publication Data

US 2010/0166447 A1 Jul. 1, 2010

(51) Int. Cl.
*G03G 15/00* (2006.01)

(52) U.S. Cl. ..... 399/88; 399/67; 399/69

(58) Field of Classification Search ..... 399/67, 399/69, 88

See application file for complete search history.

(56) References Cited

U.S. PATENT DOCUMENTS

| | | | | |
|---|---|---|---|---|
| 5,669,038 | A * | 9/1997 | Kishimoto | 399/67 |
| 6,111,230 | A | 8/2000 | Cao et al. | |
| 6,847,016 | B2 | 1/2005 | Hirst | |

FOREIGN PATENT DOCUMENTS

| | | | |
|---|---|---|---|
| EP | 1302817 | A2 * | 4/2003 |
| JP | 2001265155 | A * | 9/2001 |

* cited by examiner

*Primary Examiner* — David Gray
*Assistant Examiner* — Laura Roth

(57) ABSTRACT

A system for delivering desired magnitudes of AC power to a load. A three-cycle power mode includes a 1$^{st}$ and 3$^{rd}$ cycle in which either no AC power, or full power, is delivered to the load, and a 2$^{nd}$ cycle in which an AC switch is triggered at a desired phase angle to deliver the desired increments of AC power during the 2$^{nd}$ cycle. AC power is delivered in each cycle in a manner to provide a net zero DC offset in the AC current delivered to the load. A two-cycle mode can be achieved by using the 1$^{st}$ and 2$^{nd}$ cycle, or by using the 2$^{nd}$ and 3$^{rd}$ cycles to optimize power delivery performance. A multi-cycle power delivery system can employ both the three-cycle and the two-cycle modes together to minimize the harmonic content during delivery of various power levels.

9 Claims, 7 Drawing Sheets

POWER CONTROL FOR A PRINTER FUSER

CROSS REFERENCES TO RELATED APPLICATIONS

None.

STATEMENT REGARDING FEDERALLY SPONSORED RESEARCH OR DEVELOPMENT

None.

BACKGROUND

1. Field of the Invention

The present invention relates in general to AC power control systems, and more particularly to power control methods and apparatus for controlling the AC power delivered to a laser printer fuser.

2. Description of the Related Art

Different types of reproduction equipment employ fusers to permanently fuse toner particles onto a print medium, such as paper, to generate characters and images on the print medium. Examples of such reproduction equipment include copiers, printers, scanners, facsimile machines, and other well known equipment. The equipment receives data representative of the characters or image to be reproduced onto the print medium. Programmed circuits receive the data and apply an electrostatic charge to a print drum, whereupon the toner particles are attracted to the drum at the locations forming the characters or image. As the print medium passes over the drum, the toner particles are transferred to the print medium. The print medium then passes through a fuser that rapidly heats the toner and the paper, and with pressure the toner is melted and pressed into or onto the print medium.

The fuser requires substantial electrical power to bring the apparatus up to operating temperature and to rapidly heat the print medium during the reproduction process. Indeed, the power used to heat typical fusers can be 500-1,000 watts. During the reproduction process, the thermal energy needs of the fuser require power to be applied thereto when needed to maintain the fuser apparatus at a relatively constant temperature. To that end, most reproduction equipment employing fusers use a power control circuit which delivers electrical energy to the fuser, a temperature sensor to monitor the fuser temperature, and a programmed controller to control the overall reproduction and fusing process.

Most reproduction equipment use the AC line power to heat the fuser. The on and off cycling of AC power to the fuser can cause voltage fluctuations on the AC power line. In view of the wattage requirements of fusers, the on and off cycling of the AC power to the fuser can cause undesired operation of other equipment which also uses AC power from the same power line. For example, incandescent lights connected to the same AC power line may flicker, which is annoying. In some instances, if the fluctuation in the AC line voltage is sufficient, fluorescent lights can be extinguished. Also, some types of AC control circuits for fusers cause the generation of electrical harmonics which, when reflected back onto the AC power line, can also cause undesired operation of other equipment using the AC power. Often various governmental regulations require that the flicker and harmonics generated by reproduction equipment fusers be maintained at minimum specified levels.

In U.S. Pat. No. 6,847,016 entitled "System And Method For Controlling Power In An Imaging Device," the system converts the AC power into a DC power and drives multiple heaters for heating the fuser. The control system heats multiple heating elements of a fuser in a temporally-shifted manner to create an effective drive frequency that exceeds an actual drive frequency at which the heating elements are driven.

In U.S. Pat. No. 6,111,230, entitled "Method And Apparatus For Supplying AC power While Meeting The European Flicker And Harmonic Requirements," AC power is applied to the fuser by using phase angle techniques to apply only a portion of the AC power in each AC cycle until power is ramped up, and then using the full cycle AC power during the remainder of the heating cycle. The duration of the application of the full cycle AC power determines the steady state heat delivered to the fuser. This technique is a hybrid between phase angle control of the AC power during initial turn on of the fuser, and full cycle control during the remainder of the fuser power cycle.

In the reproduction equipment industry, there other popular methods to switch the input AC line voltage to a fuser. One technique is an integer half cycle control and the other technique is the phase angle control method, noted above. The integer half cycle control is illustrated in FIG. 1. According to this technique, the AC power control circuit outputs full half cycles of AC power to be coupled to the fuser heater. An AC switch in the control circuit turns on and off at the zero crossing and allows half cycles of the AC power to be coupled to the fuse heater. At the zero crossing points in time, the surge current coupled to the fuser is very small, thus resulting in a low harmonic content generated and reflected back into the AC power line. The same number of positive half cycles and negative half cycles are used, resulting in a zero DC offset in the AC current. While not shown, the AC switch can also be turned on at the start of a negative half cycle, as well as the start of the succeeding positive half cycle. This type of AC power control operates at a relatively low frequency, as some half cycles are used and other half cycles are not used. With a fuser powered using the integer half cycle technique, and operating at 25% power, the line voltage may fluctuate at an effective 15 Hz rate, as one full cycle is used out of every four full cycles of a 60 Hz line frequency. The 15 Hz power fluctuation may cause objectionable flicker in an incandescent lamp connected to the same AC power line.

According to another AC power control technique employed with reproduction equipment fusers, a higher frequency is utilized, where the AC switch is triggered during a partial half cycle. Typically the AC switch which controls the AC power delivered to the fuser is enabled at the same point during each half cycle, referred to as the phase angle. The phase angle technique is illustrated in FIG. 2. The rising edge of the enable signal causes the AC switch to close and to immediately couple the AC power to the fuser heater. The AC switch remains enabled during the remainder of the AC cycle until a subsequent zero crossing is sensed, whereupon the AC switch automatically opens. The partial AC cycles are output to the fuser heater, resulting in no DC offset of the AC line current. The power ratio is more difficult to calculate, as the power varies as the square of the switched sinusoidal voltage waveform. FIG. 3 illustrates the relationship between the time enable signals (delayed from a zero crossing), and the output power for a cycle with a period T in the phase angle technique. If the delay is zero, the enable signal is active at the zero crossing time and 100% power is delivered. At a delay of 4/5 of the half cycle, i.e. 8 ms at 50 Hz, the power ratio is about 5%, as opposed to the 20% level that would be expected if the power were proportional to the enable time. The resulting higher frequency power fluctuations rarely cause a visual flicker with incandescent lights using the same power line voltage. However, because the switch is actuated during non-zero crossings of each half cycle (positive and negative) of the AC voltage, there is a harmonic rich turn-on transition as the line voltage is connected to a low impedance load of the fuser heater. The harmonic content is reflected back into the input AC line and can cause the printer to fail governmental standards and regulations, and can cause unreliable operation of other equipment connected to the same AC power line.

Both the half cycle control and the phase angle control techniques are required to be applied properly to generate the same number of positive half cycles and negative half cycles of the AC power. When properly applied in practice, there should be a nominal DC offset of zero AC line current, which is also controlled by regulations.

SUMMARY OF THE INVENTION

According to the features of the invention, disclosed is a technique for delivering AC power to a load during recurring power cycles, where power may be delivered differently during the respective cycles, depending on the magnitude of power required. The cycles are delineated by zero crossings of the AC power signal. In one cycle of a group of three cycles, and for low power requirements, no AC power is delivered to the load during two of the three cycles, and power is incrementally delivered by phase angle techniques in the third cycle. For medium power requirements, full AC power is delivered in one cycle, no AC power is delivered in another cycle, and incremental power is delivered in the third cycle by phase angle techniques. When more than 66% power, for example, is required, then full power is applied in two cycles and incremental power is applied in the remaining cycle by phase angle techniques.

With regard to yet another feature of the invention, the power delivery system can incorporate just two cycles, with the third cycle identified above omitted. In order to satisfy the power requirements of the load, while yet reducing flicker and the generation of harmonics, the power delivery system can dynamically change between the three cycle mode and the two cycle mode.

According to another feature, AC power is delivered to a load during recurring groups of three cycles, where no power is delivered in one cycle according to the integer half cycle technique, power is delivered to the load in the another cycle using phase angle techniques, and power is delivered to the load in yet another cycle, again using integer half cycle techniques.

With regard to yet another embodiment, disclosed is a power delivery technique in which multiple cycles are utilized, and partial phases are used in one or more cycles. This technique increases the effective frequency and reduces the possibility of flicker. Lower harmonic generation is also achieved.

A reproduction machine incorporates a technique for delivering AC power to a fuser heater during different cycles by varying the timing of a trigger pulse applied to an AC switch. The timing of the trigger pulse is delayed from a zero crossing during one cycle a specified amount to select a phase angle of the AC power to be able to deliver substantially zero to full AC power in increments. In a different cycle, the timing of the trigger pulse is set substantially equal to the zero crossings so that either full AC power or zero AC power is delivered to the load during such cycle. In order to reduce harmonic interference, a third cycle can be used in which no AC power is delivered to the load during the cycle, or full power is delivered.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
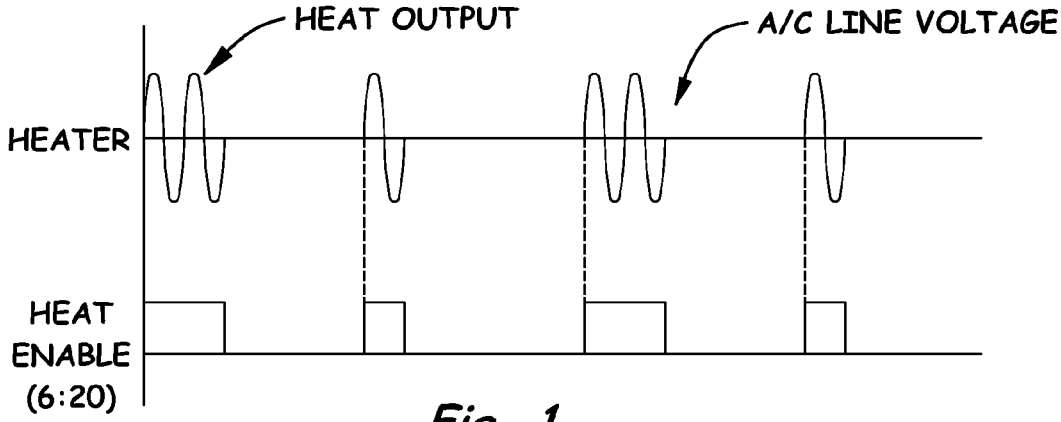
Fig. 1 (PRIOR ART)
FIG. 1 is an electrical waveform illustrating the integer half cycle AC control technique as known in the prior art.
Figure 2:
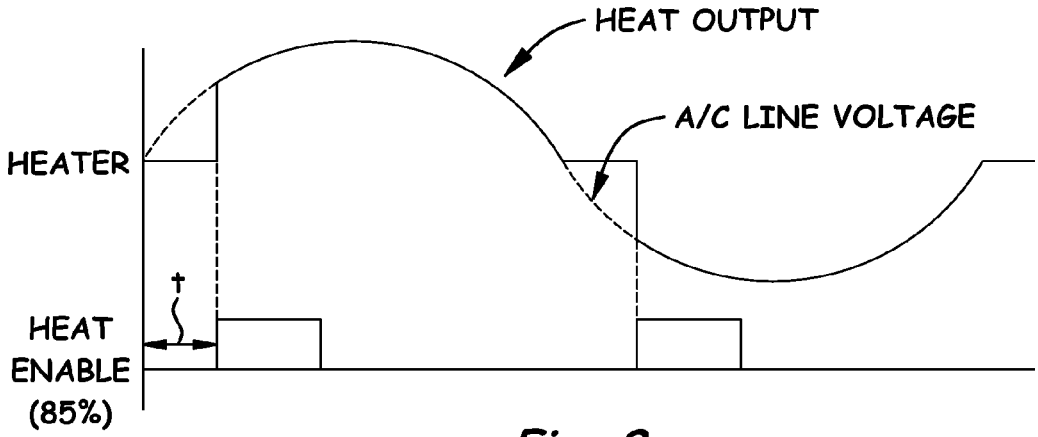
Fig. 2 (PRIOR ART)
FIG. 2 is an electrical waveform illustrating the phase angle AC control technique, also well known in the prior art.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The present invention provides a system and method for controlling the AC power applied to a fuser heater to control the temperature thereof. The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

While the preferred embodiment incorporates the AC power delivery system into a laser printer, the principles and concepts of the invention can be utilized in many other applications. Applications that are especially well adapted for using the features of the invention include those where AC power is to be delivered to a load, and the load requires different magnitudes of AC power delivered thereto. Other applications include those where the use of AC power is likely to cause flicker and the generation of harmonic energy. The features of the invention can be utilized with AC power systems having frequencies and voltages different from that used in the United States.

Figure 5:
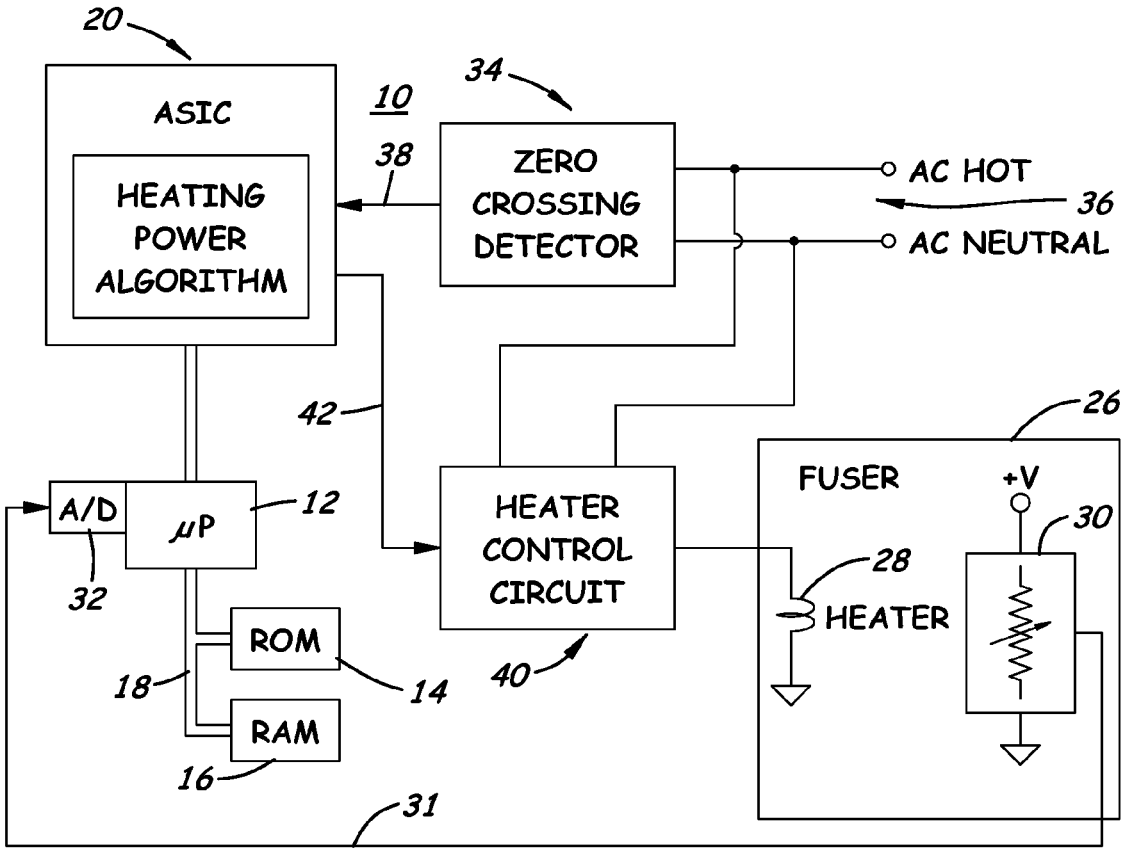
FIG. 5 is a block diagram of a reproduction system employing the features of the invention.

FIG. 5 illustrates in block diagram form a portion of a reproduction machine 10 incorporating the AC power delivery system of the invention. The reproduction machine as a whole is controlled by a programmed microprocessor 12 connected to a ROM 14 and RAM 16. The microprocessor 12 controls a controller 20 which may comprise an ASIC specially designed to control the particular type of reproduction machine 10. The microprocessor 12 is connected to the ASIC 20 by a bus 22. The control could be a combined ASIC and microprocessor, or the controller 20 could be implemented entirely as hardware circuits. In any event, the ASIC chip 20 includes a heating power algorithm 24 and a timer (not shown) for carrying out the instructions for controlling a fuser 26. The fuser 26 includes a heater 28, which may be a tungsten halogen lamp, or other heat generating element. The temperature of the fuser is monitored by a thermistor 30. The voltage generated by the thermistor is coupled on line 31 to an A/D converter 32 to digitize the same. The digital sample of the thermistor voltage can then be processed by the microprocessor 22, and/or the ASIC chip 20.

The AC control circuit includes a zero crossing detector 34. The detector 34 senses the voltage of the input AC power line and detects the occurrences of each zero crossing. The zero crossing indications are coupled to the ASIC on line 38. As will be described in more detail below, the zero crossing indications are used as a time reference for triggering a heater control unit 40. The heater control unit 40 receives timed trigger signals on line 42 from the ASIC 20 to trigger one or more AC devices, such as a triac, to couple the AC power from line 36 to the fuser heater 28. Depending on the dynamic AC power requirements of the fuser heater 28, the ASIC 20 produces triac trigger pulses to deliver AC power to the load 28 in a three-cycle mode, or a two-cycle mode, or both.

The printer 10 is programmable to control the AC power delivered to the heater 28. The temperature sensor 30 senses the temperature of the fuser 26 and sends a corresponding signal to the microprocessor 12. If the fuser 26 is not at the desired temperature, the power change can be instituted to increase or decrease the AC power delivered thereto. If power is to be increased, for example, then the controller 20 can correlate the desired increase in power to a table to determine the timing of the triac trigger signals to achieve such power. In carrying out the changes in the AC power delivered to the heater 28 various algorithms can be employed, including the well known PID algorithms to assure that the rate of change in the power is proper so as to minimize any undershoot or overshoot. Once the table indicates the correct delay timing to use in driving the heater control circuit 40, a timer in the ASIC can be employed to generate such delay timing.

Figure 4:
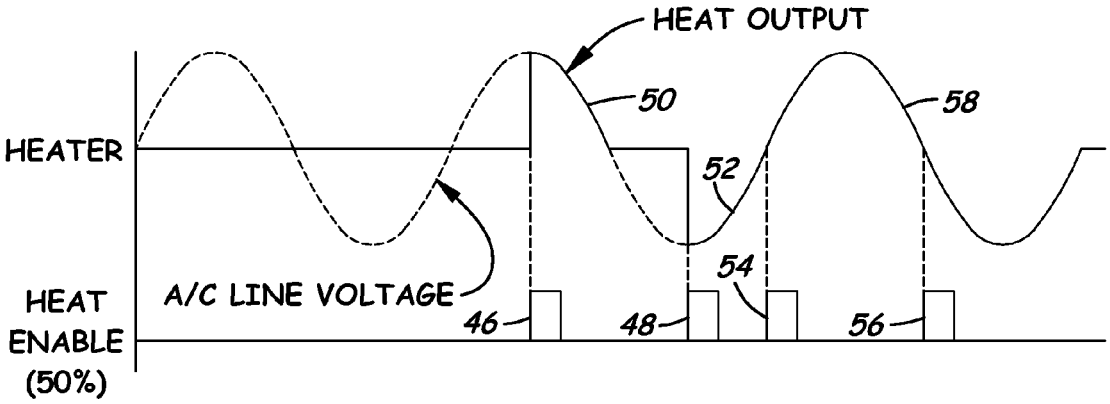
FIG. 4 is an electrical waveform illustrating a three cycle mode in which the phase angle control and integer half cycle control techniques are combined according to the invention, to provide a multi-cycle control for a load.
Figure 6:
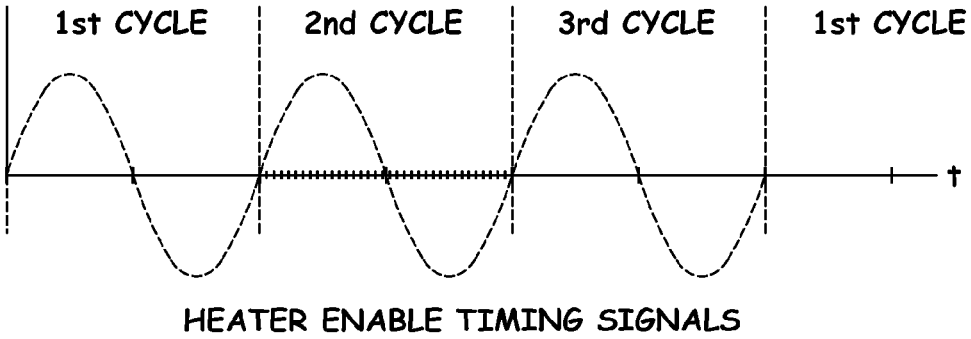
FIG. 6 is an electrical waveform depicting the cycles in a three cycle mode power delivery system.
Figure 7:
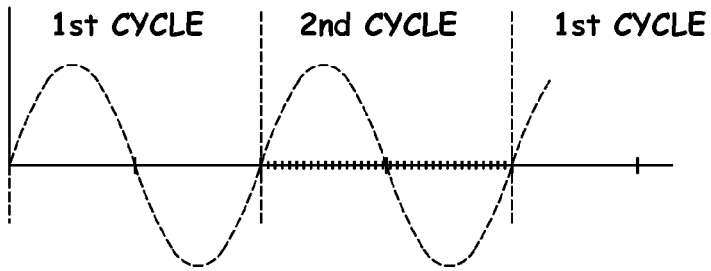
FIG. 7 is an electrical waveform depicting the cycles in a two cycle mode power delivery system.

FIGS. 4, 6 and 7 illustrate electrical waveforms that are produced by the AC power control system of the invention. FIG. 4 illustrates an example of a three cycle system where 50% power is delivered during the three-cycle duration. FIG. 6 illustrates a three-cycle mode where the AC switching device can be triggered an any number of locations during each of the three cycles, depending on the power required to be delivered. FIG. 7 illustrates a two-cycle power delivery mode. The three-cycle mode and the two-cycle mode can be combined in series to produce power during the hybrid mode.

The ASIC 20 can define two or more cycles for driving the fuser heater 28. The cycles are preferably coincident with the frequency of the AC power line 36. In FIGS. 4 and 6 there is identified a $1^{st}$ cycle, a $2^{nd}$ cycle and a $3^{rd}$ cycle. All three of the cycles can be used in a three-mode operation, or only the first two cycles (FIG. 7) in a two-mode operation, in powering the fuser heater 28. In addition, the cycles need not be in the sequence as shown, as the $1^{st}$ and the $3^{rd}$ cycles can be interchanged. Lastly, the designation herein of $1^{st}$, $2^{nd}$ or $3^{rd}$ does not indicate the particular sequence or order, but only the particular cycle being described. One of the three cycles is actively involved when delivering less than about 33% power, two cycles are actively involved when delivering between 33% power and 66% power, and all three cycles are actively involved when delivering between 66% and full power. In one embodiment, the $1^{st}$ cycle corresponds to an AC cycle, but a time in which either full power or no power is coupled to the fuser heater 28. In the example, the $1^{st}$ cycle is not used when the system delivers less than about 67% power, but is fully used when delivering in excess of about 67% power to the load. The $2^{nd}$ cycle is always active to deliver various amounts of AC power which, together with the power delivered in the $1^{st}$ and $3^{rd}$ cycles, provides the desired magnitude of AC power. In the $2^{nd}$ cycle, phase angle techniques are used to select the particular power to be delivered during such cycle. The $3^{rd}$ cycle operates much like the $1^{st}$ cycle where either a full AC cycle of power is applied to the load, or no AC power is applied at all during such cycle. Again, the sequence of the cycles for the group of three cycles can be changed.

In the configuration of cycles shown in FIG. 4, there is no power applied in the first cycle, there is fifty percent power delivered during the $2^{nd}$ cycle, and there is full power applied to the heater 28 in the $3^{rd}$ cycle. Thus, the average power applied during the three cycle period is 50%. When using the three cycle configuration, the minimum power that can be applied is substantially zero power, and the maximum power that can be applied is substantially 100%. The minimum power is when no power at all is applied during any of the three cycles. The maximum power is when full power applied during the $1^{st}$ and the $3^{rd}$ cycles, and full power is applied via the phase angle during the $2^{nd}$ cycle.

The triggering of the triac in the heater control circuit 40 is shown in FIG. 6 for three-cycle operation according to one embodiment. Of course, in the three cycle configuration, the trigger pulses applied in the $1^{st}$ cycle and the $3^{rd}$ cycle are only those to fully turn on the triac during both the positive half cycle and the negative half cycle. In the absence of trigger pulses in the $1^{st}$ and the $3^{rd}$ cycles, the triac is off and no AC power is delivered to the load. The tic marks in the $1^{st}$ and $3^{rd}$ cycles of FIG. 6 indicate the time periods when the trigger pulse can occur. In the $2^{nd}$ cycle, the triac in the heater control circuit can be triggered at any time in order to deliver power corresponding to any portion of the duty cycle of the $2^{nd}$ cycle. In other words, the duty cycle by which the triac can be triggered ranges from essentially zero power to full power during the $2^{nd}$ cycle. The many tic marks during the $2^{nd}$ cycle illustrate the many instances in which the triac can be triggered. If a fine resolution is desired in the amount of power to be delivered to the load, then many firing phase angles of the triac can be provided. In FIG. 4, the triggering on the rising edge during the positive cycle of the AC power of the $2^{nd}$ cycle is shown by trigger pulse 46. The triggering on the rising edge during the negative cycle of the AC power is shown by trigger pulse 48. The portion of power of the AC power is shown respectively by 50 and 52, namely one half of the positive AC cycle and one half of the negative AC cycle in $2^{nd}$ power cycle. The timing of the two trigger pulses 46 and 48 will vary from the zero crossing in order to vary the portions of the AC cycle to be coupled to the fuser heater 28.

It should be noted that the incorporation of a three cycle power cycle can be easily carried out by the programming the ASIC 20 to segment the AC cycles into groups of three and control the three AC cycles in each group to achieve the amount of power delivered to the load. The ASIC 20 can also be programmed to incorporate a two cycle power cycle by incorporating the $1^{st}$ cycle and the $2^{nd}$ cycle, or the $2^{nd}$ cycle and the $3^{rd}$ cycle of the three-cycle mode.

Figure 8A:
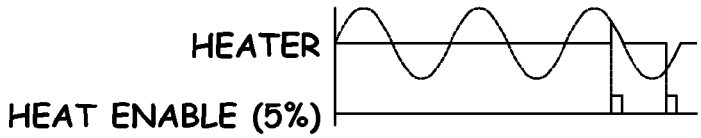
FIGS. 8*a*-8*g* illustrate a series of AC waveforms representing a three-cycle mode, and the cycle characteristics as a function of the AC power delivered.
Figure 8B:
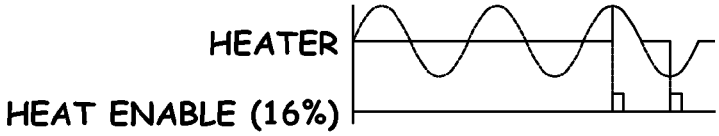
Figure 8C:
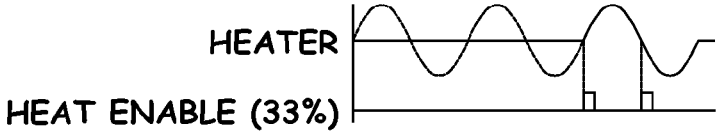

With reference now to FIGS. 8*a*-8*g*, there is illustrated another embodiment which depicts the various situations in which the three-cycle mode can be used. Of the many possible different power settings, FIG. 8 illustrates seven different power settings. It can be readily appreciated that many other power settings can be accomplished to provide a finer resolution in the increments of power delivered. The heat enable trigger signals are also shown in relative time positions to trigger the AC switch to couple AC power to the load. While not shown, if zero power is desired, such as when the load requires no AC power at all, then there is no triggering of the triac, and no AC power is delivered during any of the three cycles. In this embodiment, if power settings between zero and about 33% are desired, then the third cycle is active in delivering power. If power settings between about 33% and 66% are desired, then the second and third cycles are active, and if power settings between about 66% and 100% are desired, then all three cycles are active in delivering power. In particular, it can be seen that for power magnitudes between zero and about 33% as shown in FIGS. 8*a*-8*c*, then the triac is only triggered during the third cycle, and the trigger is delayed the specified amount to achieve the desired AC power output.

Figure 8D:
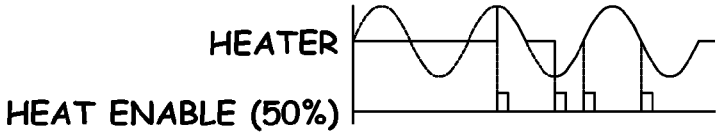
Figure 8E:
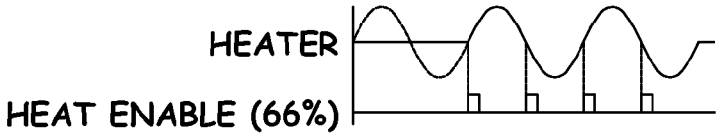

Once the desired amount of power required exceeds about 33%, the triac is triggered in the third cycle so as to be fully on during the entire cycle, and the additional AC power is obtained by phase angle triggering the triac in the second cycle. For additional amounts of AC power up to about 66%, then the trac is triggered earlier in the second cycle to incrementally increase the AC power delivered, as shown by FIGS. 8*d*-8*e*. This occurs up to a power magnitude of about 66% where full power is delivered in both the second cycle and the third cycle, as shown by FIG. 8*e*.

Figure 8F:
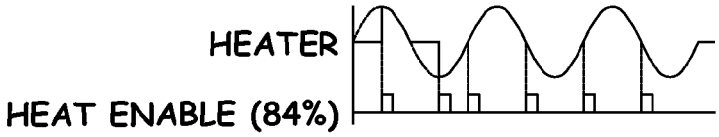
Figure 8G:
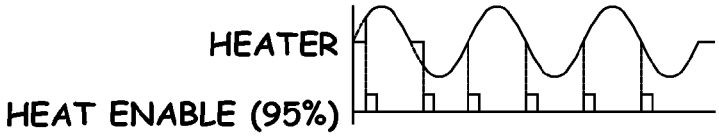

Once the desired magnitude of power exceeds about 66%, then the triac is triggered in the second cycle and the third cycle to the fully on conditions to provide full power, and the triac is triggered in the first cycle to achieve the additional increments in power needed. This is illustrated in FIGS. 8*f* and 8*g*. In order to incrementally increase the power beyond the 66% magnitude, the triac is triggered earlier in the first cycle (less delay). When 100% power is desired, then the triac is triggered on fully in all three cycles. In this embodiment, triac can be triggered in each cycle to incrementally deliver power, depending on the power level desired. The ability to trigger the triac in every cycle would be different from that described above in connection with FIG. 6.

Figure 9A:
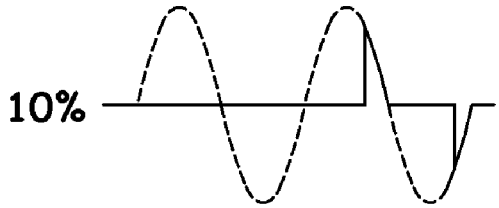
FIGS. 9*a*-9*j* illustrate a series of AC waveforms representing a two-cycle mode, and the cycle characteristics as a function of the AC power delivered.
Figure 9B:
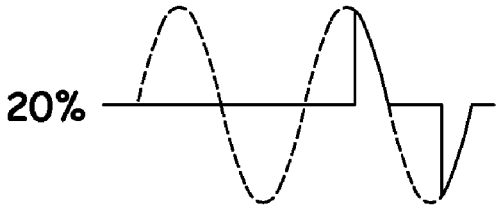
Figure 9C:
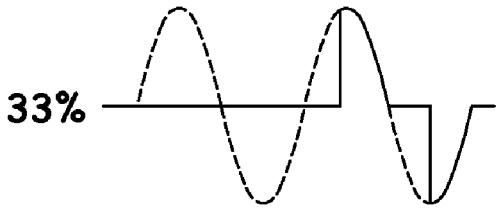
Figure 9D:
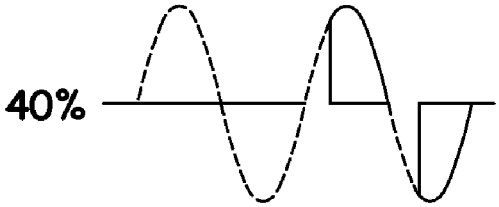
Figure 9E:
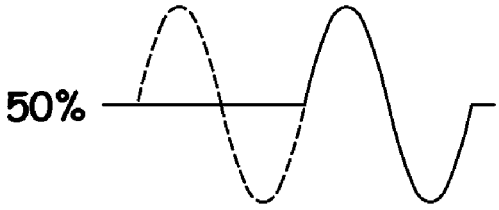
Figure 9F:
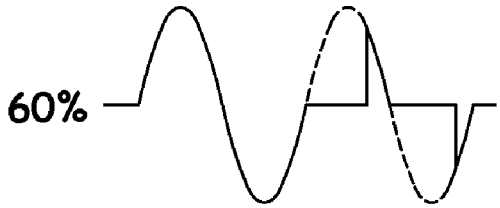
Figure 9G:
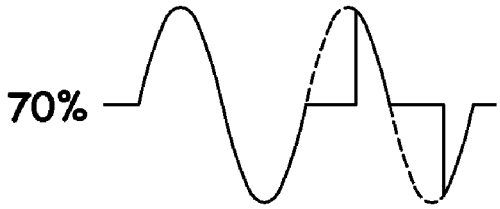
Figure 9H:
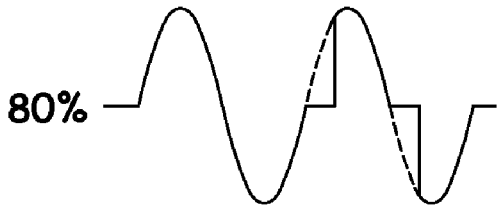
Figure 9I:
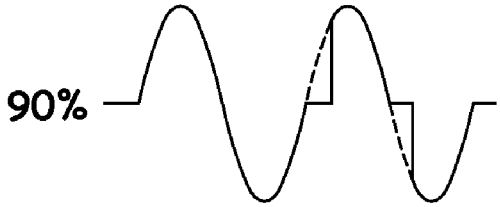

The two-cycle operation is illustrated in FIGS. 9*a*-9*j*. With this mode of operation, the AC power delivery system can again deliver AC power from zero to full 100% magnitudes. Again, if it is desired to deliver zero power, then no trigger pulses are generated during either of the two cycles and the triac remains off during such time. When power is delivered in increments from 1% to just under 50%, the triac is not triggered at all during the first cycle, but is triggered progressively earlier in the second cycle, as shown in FIGS. 9*a*-9*d*. When 50% power is desired, then the triac is triggered on at the zero crossing points in the second cycle so that full power is delivered only during the second cycle, as shown in FIG. 9*e*. Fifty percent power can also be obtained if the triac is triggered fully on in the first cycle and not at all in the second cycle.

Figure 9J:
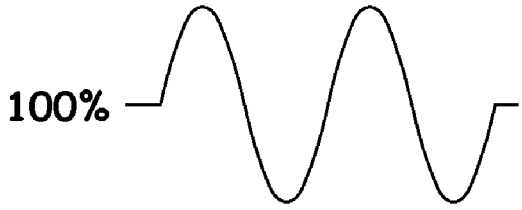

When delivering AC power that exceeds the 50% power level, the first cycle is triggered to a fully on state, and the triac is triggered on with a delay that incrementally decreases during the second cycle to progressively increase the power. This is shown in FIGS. 9*f*-9*i*. When 100% power is desired, then the triac is triggered to provide full power during both the first and the second cycle, as shown in FIG. 9*j*.

FIGS. 10*a*-10*h* illustrate yet another embodiment, in which multiple cycles in each group utilize partial phases. In this embodiment, three AC cycles are employed, and the amplitudes of the AC power in some of the phases can be substantially off, or substantially 100%, thus providing low harmonic generation during such cycles. Because some of the cycles are at least partially on, at times, the effective frequency of the AC power is higher than in the other embodiments. This can reduce flicker. The triac heat enable trigger pulses are shown in each of the drawings of FIG. 10*a*-10*h*.

Figure 3:
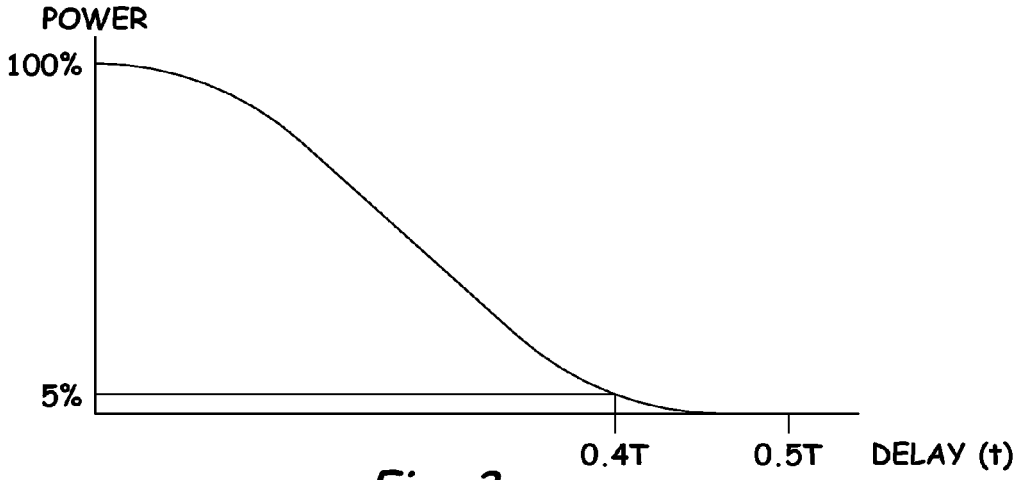
FIG. 3 graphically depicts the relationship between power and the enable time of the phase control technique of FIG. 2.
Figure 10A:
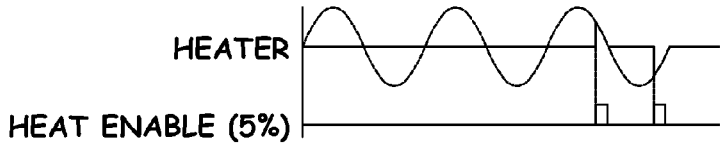
FIGS. 10*a*-10*h* illustrate another embodiment in which partial phases are utilized in multiple cycles.
Figure 10B:
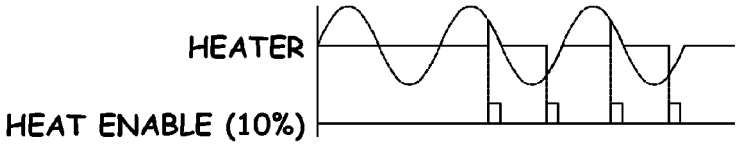
Figure 10C:
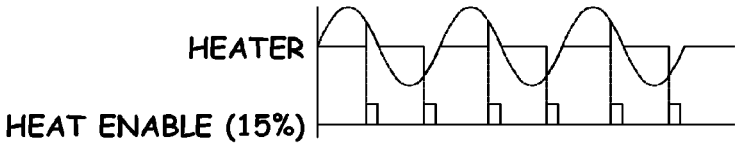
Figure 10D:
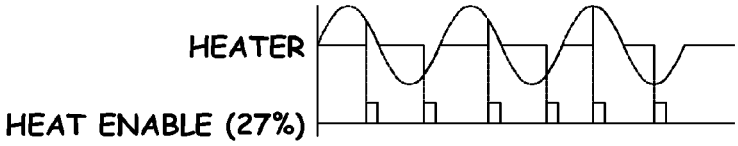

In FIG. 10*a*, 5% average AC power is delivered over three cycles by triggering the triac at a desired phase angle in the third cycle. Fifteen percent AC power is delivered in the third cycle using the delay shown in FIG. 3, resulting in an average power over three cycles of 5%. In FIG. 10*b*, 10% average AC power is delivered by triggering the triac at the same phase angle in the second and third cycles. Zero power is delivered in the first cycle, and 15% AC power is delivered in each of the second and third cycles, resulting in an average AC power of 10% over three cycles. In FIG. 10*c*, 15% average AC power is delivered by triggering the triac at the same phase angle in the first, second, and third cycles. Fifteen percent AC power is delivered in each of the three cycles, resulting in an average AC power of 15% over three cycles. In FIG. 10*d*, 27% average AC power is delivered by triggering the triac at the same phase angle in the first and second cycles, and at a different phase angle in the third cycle. Fifteen percent AC power is delivered in each of the first and second cycles, and 50% AC power is delivered in the third cycle to provide an average AC power of 27% over the three cycles.

Figure 10E:
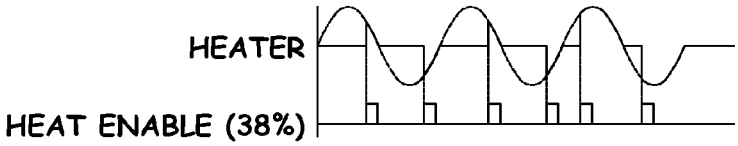
Figure 10F:
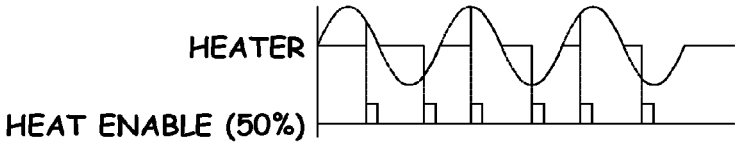
Figure 10G:
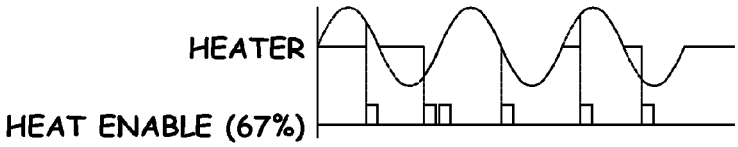
Figure 10H:
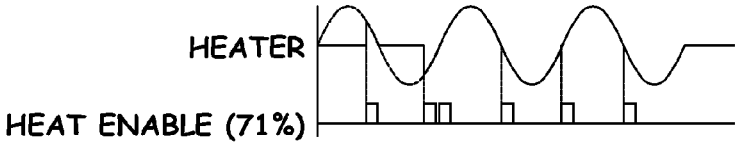

FIG. 10*e* illustrates a situation in which 38% average AC power can be delivered to the load. Fifteen percent AC power is delivered in each of the first and second cycles, and 85% AC power is delivered in the third cycle, resulting in an average AC power of 38% delivered over three cycles. FIG. 10*f* illustrates a situation in which 50% average AC power can be delivered to a load. Fifteen percent AC power is delivered in the first cycle, 50% AC power is delivered in the second cycle, and 85% AC power is delivered in the third cycle. An average AC power of 50% is thus delivered over three cycles. FIG. 10*g* illustrates a situation in which 67% average AC power is delivered to the load. Fifteen percent AC power is delivered in the first cycle, 100% AC power is delivered in the second cycle, and 85% AC power is delivered in the third cycle. An average AC power of 67% is thus delivered over three cycles. Lastly, FIG. 10*h* illustrates a situation in which 71% average AC power is delivered to the load. Fifteen percent AC power is delivered in the first cycle, and 100% AC power is delivered in each of the second and third cycles. An average AC power of 71% is thus delivered over three cycles. As can be appreciated, the triac can be triggered differently in each of the three cycles to achieve any increments of AC power delivered to the load.

Figure 11:
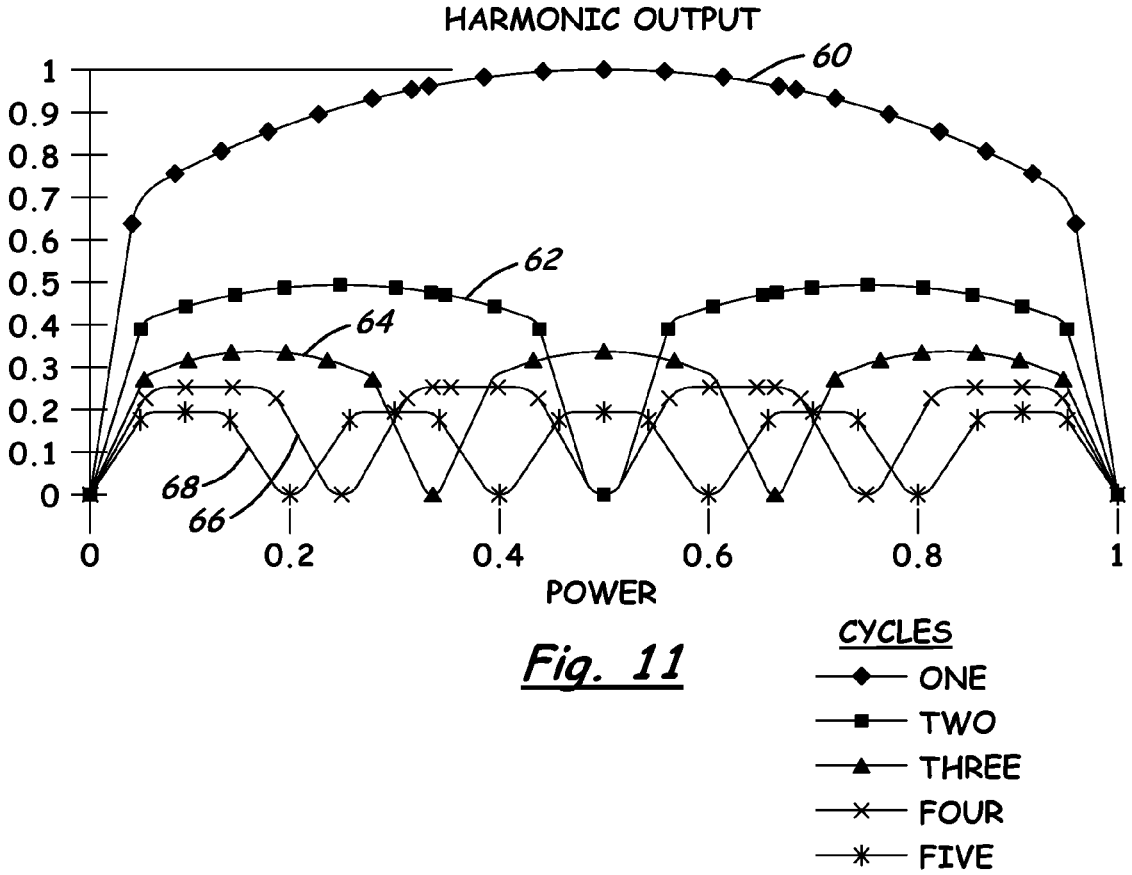
FIG. 11 graphically depicts the harmonic power versus the percent power delivered, as a function of the number of cycles in an AC power delivery system according to the invention.

FIG. 11 graphically illustrates the harmonic content as a function of power delivered, with different numbers of cycles. A conventional one cycle power delivery system employing the phase angle technique is shown as reference numeral 60. The harmonic content of such a prior art system is approximately proportional to the square of the input voltage when enabled. It is noted that for a one cycle system, the harmonic content is greatest at about half power, and is greater than any of the other multi-cycle systems. In contrast the harmonic content for a two cycle system 62 is about zero at the 50% power level, as is the four cycle system 66.

When employing a three cycle AC power delivery system, the harmonic content is nearly zero at the 0%, 33% and 67% power levels, as shown by line 64. It is also noted in FIG. 10 that the harmonic content decreases as the number of power delivery cycles increases. This is because the line disturbances resulting from the generation of a partial cycle (phase angle) is combined with other integer half cycles in which no harmonic disturbance is generated. A four cycle system is shown by line 66 and a five cycle system is shown by line 68.

From the foregoing, it can be seen that in order to minimize harmonic disturbance on the AC power line, then the cycle number (mode) can be chosen based on the power desired to be delivered, and the cycle number can change dynamically. In other words, if it is desired to provide AC energy at a 50% power level, then the power delivery system should be configured to employ the two cycle mode, as this mode exhibits the lowest harmonic disturbance at the 50% power level. When it is desired to change the power requirements to, for example, a 33% power level, or a 67% power level, then the system can be configured dynamically to switch to the three cycle mode. As noted above, the changing of modes simply requires the identification of a different group of AC cycles, and change the trigger pulse timing to correspond to the desired mode. As also noted above, the mode, triac trigger timing and power level can be programmed in the controller 20 using one or more look-up tables to achieve the appropriate correlation of parameters. Accordingly, a multi-cycle control of power in a delivery system can provide significant benefits.

The number of cycles, or mode, can also be selected based on other criteria, such as the power line frequency or power line voltage. A multi-cycle mode can be selected for high power line voltages, such as 220V, and a single cycle mode can be selected for lower power line voltages, such as 100V or 110V. The single cycle mode reduces flicker (although it produces a high harmonic content) which is a larger problem at lower power line voltages due to the higher currents used. On the other hand, when using higher power line voltages, the harmonic content can be reduced by employing multi-cycle modes.

Increasing the number of cycles can be advantageous in reducing the low limit on power, and reducing the resulting flicker. Due to circuit design constraints, frequency variations and timing limits, there is a minimum power output for a phase angle control system. When a power is selected below that limit, the delay time approaches the half-cycle period. The trigger pulse width may reach the zero-voltage crossover time, resulting in an unexpected full half cycle output. If this happens for several cycles, the output power changes from very low power to a high power, with unexpected results. This problem becomes more difficult when there are fluctuations in the line frequency.

In yet another system, the multi-cycle control is selected for very low power operation, such as when maintaining a fuser in a standby status, but single cycle control is selected for high power operation, such as when initially heating the fuser and when printing. The time limit to avoid the zero-crossover period only applies to the single phase mode, so operating without delivering power in several complete cycles reduces the minimum power available by that factor. For instance, if the minimum power for single cycle phase control is 5%, operating with two cycles results in a minimum power of 2.5%.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of delivering AC power at different magnitudes to drive a load, comprising:

sensing zero crossings of an AC power signal used to power to the load;

identifying plural groups of cycles where each group includes at least two cycles segmented by zero crossings, where the groups occur in time immediately adjacent each other;

for each said group, delivering AC power in one cycle using a desired phase angle; and for each said group, and in a different cycle, delivering AC power with a phase angle different from the phase angle of said one cycle if it is desired to incrementally increase the AC power in said different cycle;

wherein said identifying plural groups of cycles includes dynamically changing between a two-cycle mode and a three-cycle mode for power delivery to the load.

2. The method of claim 1 further including delivering no AC power during said different cycle if it is desired to minimize the total AC power in said different cycle, and delivering full AC power in said different cycle if it is desired to maximize the AC power in said different cycle.

3. The method of claim 1, wherein a substantially zero power to a substantially full power is delivered during a third cycle of identified groups of three cycles.

4. The method of claim 1 further including varying a delay time of a trigger pulse from a zero crossing during a cycle of each said group to select a desired AC power to be delivered during said cycle.

5. The method of claim 4 further including generating a trigger pulse during said different cycle to deliver full power during said different cycle, and suppressing the trigger pulse during said different cycle to deliver substantially zero power during said different cycle.

6. The method of claim 4 further including using a look-up table to determine a delay time to determine a desired power to deliver during each said cycle.

7. The method of claim 5 further including suppressing a generation of a trigger pulse during one cycle to reduce harmonic generation during said three-cycle mode.

8. The method of claim 5 further including using a single trigger generator to generate trigger pulses for both said one and said different cycles.

9. The method of claim 1 further including triggering an AC switch in said one cycle and said different cycle so as to produce a net zero DC offset in an AC current delivered to the load.

* * * * *